US009985341B2

(12) United States Patent
Shewan et al.

(10) Patent No.: US 9,985,341 B2
(45) Date of Patent: May 29, 2018

(54) DEVICE ANTENNA FOR MULTIBAND COMMUNICATION

(71) Applicant: Microsoft Technology Licensing, LLC, Redmond, WA (US)

(72) Inventors: Benjamin Shewan, Redmond, WA (US); Stanley Yu Tao Ng, Bellevue, WA (US); Sidharath Jain, Kirkland, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 213 days.

(21) Appl. No.: 14/841,297

(22) Filed: Aug. 31, 2015

(65) Prior Publication Data

US 2017/0062912 A1 Mar. 2, 2017

(51) Int. Cl.

| | |
|---|---|
| ***H01Q 1/12*** | (2006.01) |
| ***H01Q 1/27*** | (2006.01) |
| ***H01Q 1/52*** | (2006.01) |
| ***H01Q 5/35*** | (2015.01) |
| ***H01Q 1/24*** | (2006.01) |
| ***H01Q 1/44*** | (2006.01) |
| ***H01Q 7/00*** | (2006.01) |
| ***H01Q 13/10*** | (2006.01) |

(52) U.S. Cl.

CPC ..... *H01Q 1/273* (2013.01); *H01Q 1/243* (2013.01); *H01Q 1/44* (2013.01); *H01Q 1/526* (2013.01); *H01Q 5/35* (2015.01); *H01Q 7/00* (2013.01); *H01Q 13/10* (2013.01)

(58) Field of Classification Search

None

See application file for complete search history.

(56) References Cited

U.S. PATENT DOCUMENTS

| | | | |
|---|---|---|---|
| 4,754,285 | A | 6/1988 | Robitaille |
| 4,821,040 | A | 4/1989 | Johnson et al. |
| 4,994,817 | A | 2/1991 | Munson et al. |
| 5,194,876 | A | 3/1993 | Schnetzer et al. |
| 5,621,419 | A | 4/1997 | Meek et al. |
| 5,757,326 | A | 5/1998 | Koyama et al. |
| 5,798,984 | A | 8/1998 | Koch |
| 5,926,144 | A | 7/1999 | Bolanos et al. |
| 5,995,058 | A | 11/1999 | Legay et al. |

(Continued)

FOREIGN PATENT DOCUMENTS

| | | | |
|---|---|---|---|
| EP | 2405534 | A1 | 1/2012 |
| GB | 2516304 | A | 1/2015 |

(Continued)

OTHER PUBLICATIONS

International Searching Authority, U. S. Patent and Trademark Office, International Search Report for PCT US2015/055408 dated Nov. 19, 2015, 5 pages.

(Continued)

*Primary Examiner* — Trinh Dinh

(74) *Attorney, Agent, or Firm* — Holzer Patel Drennan

(57) ABSTRACT

A wearable electronic device includes a bezel encasing device electronics and having a metallic portion and a dielectric insert portion. The metallic portion of the bezel is grounded at a point of zero potential and coupled to a differential feed structure that spans the dielectric insert portion to feed opposite ends of the metallic portion.

20 Claims, 5 Drawing Sheets

(56) References Cited

U.S. PATENT DOCUMENTS

| | | | | |
|---|---|---|---|---|
| 6,008,772 | A | 12/1999 | Legay et al. | |
| 6,034,645 | A | 3/2000 | Legay et al. | |
| 6,212,414 | B1 | 4/2001 | Alameh et al. | |
| 6,950,685 | B2 | 9/2005 | Barras et al. | |
| 7,230,885 | B2 | 6/2007 | Sakurazawa et al. | |
| 7,271,774 | B2 | 9/2007 | Puuri | |
| 7,714,790 | B1 | 5/2010 | Feldstein et al. | |
| 8,169,374 | B2 | 5/2012 | Hill et al. | |
| 8,253,640 | B2 | 8/2012 | Kitayoshi et al. | |
| 8,270,914 | B2 | 9/2012 | Pascolini et al. | |
| 8,556,168 | B1 | 10/2013 | Lewis et al. | |
| 8,599,088 | B2 | 12/2013 | Chiang et al. | |
| 8,610,638 | B2 * | 12/2013 | Larsen | H01Q 5/35 343/728 |
| 8,833,665 | B2 | 9/2014 | Grange et al. | |
| 8,847,832 | B2 * | 9/2014 | Parsche | H01Q 7/00 343/732 |
| 9,070,969 | B2 * | 6/2015 | Mow | H01Q 1/243 |
| 2003/0117903 | A1 | 6/2003 | Nakajima et al. | |
| 2005/0219955 | A1 | 10/2005 | Xu et al. | |
| 2007/0046543 | A1 | 3/2007 | Choi et al. | |
| 2008/0165071 | A1 | 7/2008 | Chiang et al. | |
| 2008/0316112 | A1 * | 12/2008 | Zhang | H01Q 1/38 343/700 MS |
| 2011/0012794 | A1 | 1/2011 | Schlub et al. | |
| 2011/0013491 | A1 | 1/2011 | Fujisawa | |
| 2011/0234461 | A1 | 9/2011 | Grange et al. | |
| 2011/0241948 | A1 | 10/2011 | Bevelacqua et al. | |
| 2011/0260939 | A1 | 10/2011 | Korva et al. | |
| 2012/0009983 | A1 * | 1/2012 | Mow | H01Q 1/243 455/575.7 |
| 2012/0256808 | A1 | 10/2012 | Owens | |
| 2013/0016016 | A1 | 1/2013 | Lin et al. | |
| 2013/0101005 | A1 | 4/2013 | Aryanfar | |
| 2013/0109305 | A1 | 5/2013 | Savoj et al. | |
| 2013/0127673 | A1 | 5/2013 | Chang et al. | |
| 2013/0135158 | A1 | 5/2013 | Faraone et al. | |
| 2013/0225070 | A1 | 8/2013 | Lin | |
| 2013/0249753 | A1 | 9/2013 | Kenichi et al. | |
| 2013/0342407 | A1 | 12/2013 | Kvist et al. | |
| 2014/0139637 | A1 | 5/2014 | Mistry et al. | |
| 2014/0225786 | A1 | 8/2014 | Lyons et al. | |
| 2014/0266624 | A1 | 9/2014 | Van Bosch et al. | |
| 2014/0266920 | A1 | 9/2014 | Tran et al. | |
| 2014/0354494 | A1 | 12/2014 | Katz | |
| 2015/0002350 | A1 * | 1/2015 | Vance | H01Q 1/243 343/745 |
| 2015/0009075 | A1 | 1/2015 | Lau et al. | |
| 2015/0048979 | A1 | 2/2015 | Asrani et al. | |
| 2015/0109172 | A1 | 4/2015 | Iijima et al. | |
| 2015/0349410 | A1 | 12/2015 | Russell et al. | |
| 2016/0006109 | A1 | 1/2016 | Apaydin et al. | |
| 2016/0006110 | A1 | 1/2016 | Jain et al. | |
| 2016/0285520 | A1 * | 9/2016 | Baek | H01Q 1/243 |

FOREIGN PATENT DOCUMENTS

| | | | |
|---|---|---|---|
| JP | H9247006 | A | 9/1997 |
| JP | 2004032303 | A | 1/2004 |
| WO | 20130132715 | A1 | 9/2013 |
| WO | 2013188977 | A2 | 12/2013 |
| WO | 2015053535 | A1 | 4/2015 |

OTHER PUBLICATIONS

International Searching Authority, U.S. Patent and Trademark Office, Written Opinion for PCT US2015/055408, dated Nov. 27, 2015, 8 pages.

Stevens, Tim, "Pebble Steel Declassified: Raising the Smartwatch Design Bar without Breaking the Mold", Published on: Jan. 6, 2014 Available at: http://www.cnet.com/news/pebble-steel-declassified-raising-the-smartwatch-design-bar-without-breaking-the-mold/.

"Fenix 3", Published on: Jan. 22, 2015 Available at: http://fenix3.garmin.com/en-US/.

Zhang, et al., "Integrated Dual-Band Antenna System Design Incorporating Cell Phone Bezel", In Journal of IEEE Antennas and Wireless Propagation Letters, vol. 7, May 16, 2008, pp. 585-587.

Stern, Becky, "Inside the Moto 360", Retrieved on: Jan. 22, 2015 Available at: http://learn.adafruit.com/moto-360-smartwatch-teardown/inside-the-moto-360.

"Real World NFC Antenna", Published on: Sep. 1, 2013 Available at: http://www.antenna-theory-com/definitions/nfc-antenna.php.

Haga, et al, "A Cavity-Backed Slot Antenna for On-Body BAN Devices", In Proceedings of International Workshop on Antenna Technology: Small Antennas and Novel Metamaterials, Mar. 4, 2008, 510-513.

"International Search Report and Written Opinion Issued in PCT Application No. PCT/US2016/044948", dated Nov. 2, 2016,12 Pages.

Non-Final Office Action issued in U.S. Appl. No. 14/517,666, dated Feb. 2, 2016, 10 pages.

Non-Final Office Action issued in U.S. Appl. No. 14/517,707, dated Feb. 2, 2016, 11 pages.

Non-Final Office Action issued in U.S. Appl. No. 14/517,666, dated Aug. 5, 2016, 16 pages.

Non-Final Office Action issued in U.S. Appl. No. 14/517,707, dated Aug. 9, 2016, 12 pages.

International Searching Authority, U. S. Patent and Trademark Office, Second Written Opinion for PCT/US2015/055408 dated Sep. 20, 2016, 7 pages.

International Searching Authority, U.S. Patent and Trademark Office, International Search Report dated Sep. 29, 2015, 5 pages.

International Searching Authority, U.S. Patent and Trademark Office, Written Opinion, dated Oct. 6, 2015, 7 pages.

* cited by examiner

DEVICE ANTENNA FOR MULTIBAND COMMUNICATION

BACKGROUND

The trend of increasingly small, portable consumer electronics presents challenges in designing suitable antennas. Many current electronic devices are designed to transmit or receive signals in multiple frequency bands (e.g., cellular, Wi-Fi, Near Field Communication (NFC), Bluetooth®, GPS). Therefore, in addition to offering multi-band resonance options, such antennas may also be sized, shaped, and positioned to mitigate interference with other antennas and/or device electronics.

SUMMARY

Implementations described and claimed herein address the foregoing by forming a antenna configured for resonance at multiple selectable frequencies. The antenna surrounds electronics of a device and has a metallic portion and a dielectric insert portion. A differential feed structure spans the dielectric insert portion to feed opposite ends of the metallic portion, and the metallic portion is grounded at a point of zero potential.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

DETAILED DESCRIPTION

Figure 1:
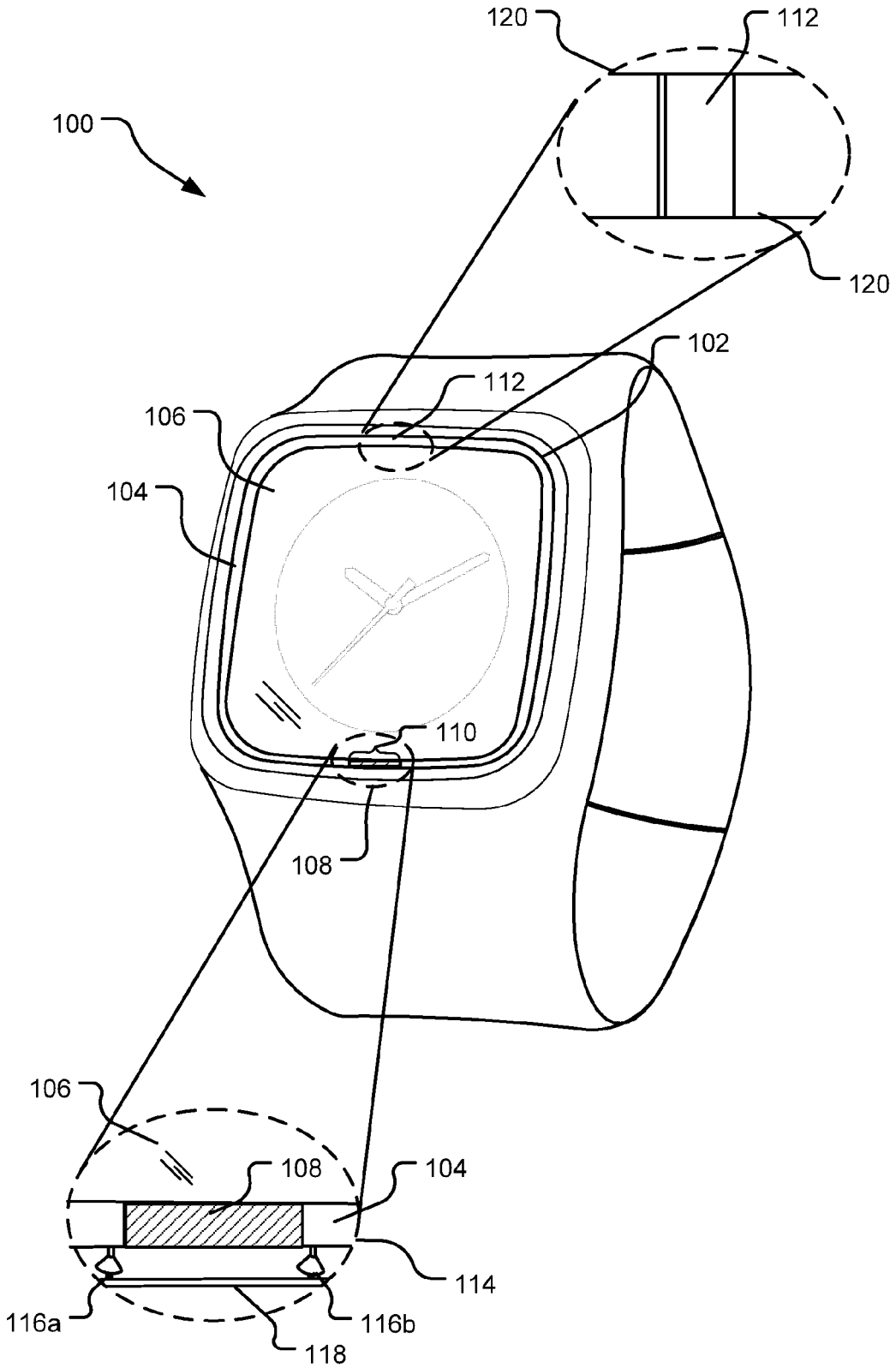
FIG. 1 illustrates an example wearable electronic device including a bezel configured for resonance in multiple frequency bands.

FIG. 1 illustrates an electronic device 100 including an example bezel 102 configured for resonance in multiple frequency bands. The electronic device 100 includes a bezel 102 that encases a display 106 and further includes device electronics (not shown) housed beneath the display 106. In the illustrated implementation, the electronic device 100 is a watch, but in other implementations, the electronic device 100 could be another type of wearable or non-wearable electronic device including without limitation a tablet, phone, ring, keychain, stylus, etc.

The bezel 102 includes a metallic portion 104 and a dielectric insert portion 108 that together complete a perimeter surrounding the display 106. The dielectric insert portion 108 fills a notch or gap 110 within metallic portion 104. In FIG. 1, the bezel 102 forms an exterior surface of the electronic device 100. For example, a metallic rim on the outside of a watch dial can act as an industrial design feature as well as an antenna. In other implementations, the bezel 102 may form an interior surface of the electronic device 100.

As shown in detail in expanded view 114, differential feed lines 116*a*, 116*b* couple a printed circuit board assembly (PCBA) 118 to the metallic portion 104 on opposite sides of the dielectric insert portion 108. In one implementation, the differential feed lines 116*a*, 116*b* resonate the bezel 102 at a near field communication (NFC) frequency. Resonance at an NFC frequency allows the bezel 102 to communicate with other NFC-equipped devices by touching the devices together or bringing them into proximity to a distance of less than about 10 cm, depending on antenna specifics.

The metallic portion 104 of the bezel 102 further includes at least one electrically grounded point 112, shown attached to the PCBA 118 in expanded view 120. The electrically grounded point 112 may be diametrically opposite to the dielectric insert portion 108 (as shown in FIG. 1), or otherwise positioned about the circumference of the metallic portion of the bezel 104 (e.g., as discussed below with respect to FIGS. 2-4). In other implementations, the bezel 102 includes an electrically grounded point that is not positioned diametrically opposite the dielectric insert portion 108. The electrically grounded point 112 acts as an antenna short for additional bands of antenna operation. For example, the electronic device 100 may further include one or more additional signal feeds between the electrically grounded point 112 and the dielectric insert portion 108 that provide for resonance of the bezel 102 in one or more different frequency bands including without limitation Wi-Fi, cellular, BlueTooth®, GPS, etc.

Figure 2:
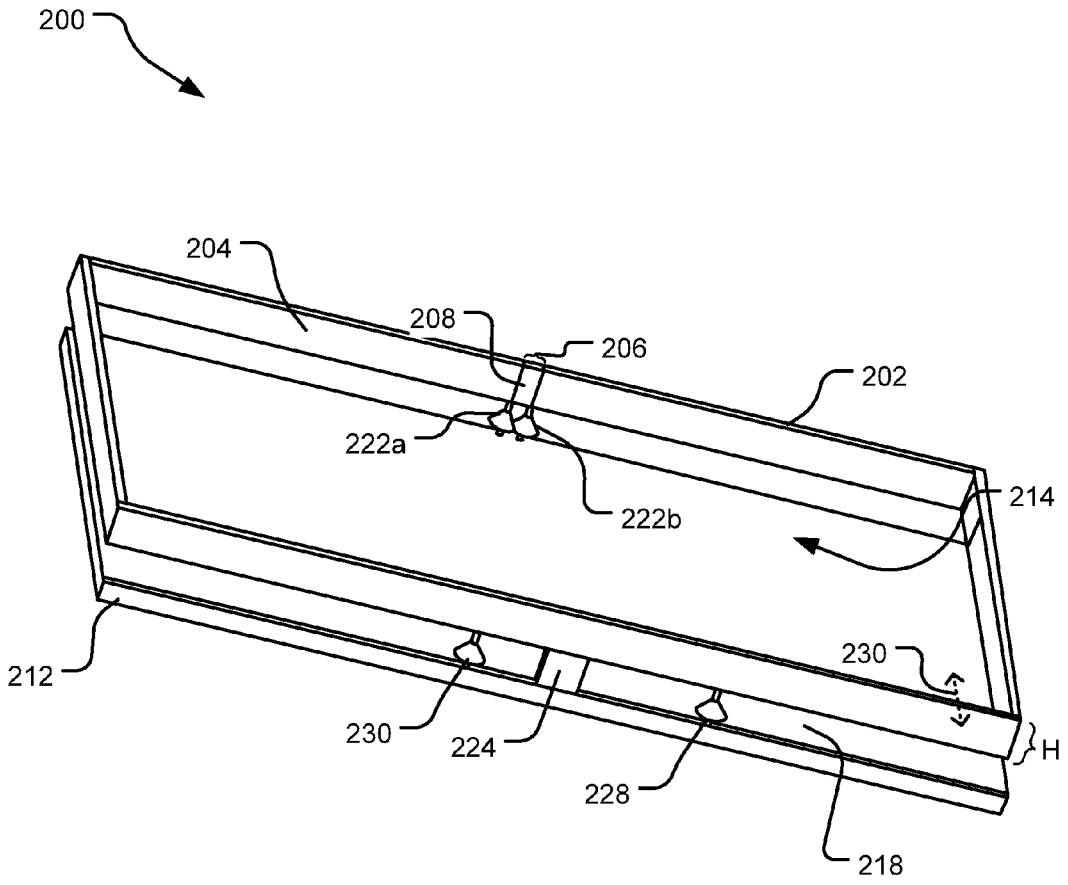
FIG. 2 illustrates a front perspective view of a portion of a wearable electronic accessory including an example bezel configured for resonance in multiple frequency bands.

FIG. 2 illustrates a front perspective view of a portion of a wearable electronic accessory 200 including an example bezel 202 configured for resonance in multiple frequency bands. The bezel 202 includes a rectangular rim enclosing a region 214 that houses various electronics (not shown) of the wearable electronic accessory 200.

The bezel 202 is positioned above and axially aligned with a printed circuit board assembly (PCBA) 212 that provides electrical connections to the various electronics of the wearable electronic assembly 200 that are housed within the enclosed region 214. In one implementation, the bezel 202 encompasses a display (not shown) and also encompasses a plane including the various electronics stored beneath this display. A height (H) of the bezel 202 and thickness of the perimeter of the bezel 202 (e.g., thickness measured along an axis 230) can vary in different implementations but may be, for example, greater than about 20 microns.

A sheet 218 with a high permeability and low magnetic loss is positioned between the bezel 202 and the underlying electronics (e.g., the PCBA 212, a battery) to prevent coupling of the bezel 202 with any of the electronics. In one implementation, the sheet 218 is a ferrite sheet. The sheet 218 may be, for example, secured beneath the display and above the PCBA 212. In one implementation, the sheet 218 has a length and width greater than or equal to a corresponding length and width of the bezel 202. Some implementations may not include the sheet 218.

In one implementation where the wearable electronic accessory 200 is a watch, the bezel 202 forms an external surface of the watch, such as a perimeter surface encompassing the watch dial. The position of the bezel 202 may be above, below, or in-line with the watch dial to achieve a desired inductance, which may vary based on specific design details.

The bezel 202 includes a metallic portion 204 and a dielectric insert portion 208. In one implementation, the metallic portion 204 is a continuous, monolithic component. In other implementations, the metallic portion 204 includes multiple electrically connected components.

The dielectric insert portion 208 is positioned to fill a slot 206 in the metallic portion 204. Differential feed lines 222*a*, 222*b* straddle the dielectric insert portion 208, providing two alternating current (AC) sources 180 degrees out of phase with one another on opposite sides of the dielectric insert portion 208, as shown. In one implementation, the AC current is of a frequency corresponding to an NFC frequency band.

A metal support 224 electrically grounds the bezel 202 to the PCBA 212. In one implementation, the metal support 224 is located at a midpoint (e.g., an exact center along a length) of the metallic portion 204. Since a net electrical potential is zero at the midpoint due to interference of the out of phase signals from the differential feed lines 222*a*, 222*b*, grounding of the metal support 224 does not affect resonance of the bezel 202 due to current flowing from the differential feed lines 222*a* and 222*b*. Points along the bezel 200 that have no electric potential due to signal cancellation are referred to herein as points of "complete interference" or "zero potential." The midpoint of the metallic portion 204 is one point of complete interference suitable for grounding. In other implementations, an electrical ground is located at one or more other points of complete interference along the perimeter of the bezel 200.

Grounding of the metal support 224 is advantageous because it allows different portions of the bezel 202 to be selectively resonated in other frequency bands. For example, supplemental feed lines 228, 230 can be positioned on opposite sides of the ground point (e.g., the metal support 224) to provide multi-band resonance of the bezel 202.

The supplemental feed line 228 delivers current at a frequency Fl, corresponding to a resonant frequency of the metallic portion 204 along a path from the supplemental feed line 228 to the differential feed lines 222*a*/222*b*. Similarly, the second supplemental feed line 230 delivers current at a frequency F2, corresponding to a resonant frequency of the metallic portion 204 along a path between the second supplemental feed line 230 and the differential feed lines 222*a*/222*b*. The metal support 224 acts as a short for the bands of antenna operation at the frequencies F1 and F2.

In various implementations, exact positions of the supplemental feed lines 228, 230 may vary based on input signal and desired resonance characteristics. Consequently, the bezel 202 is capable of transmitting in at least three select frequency bands (corresponding to frequencies supplied by (1) the differential feed lines 222*a* and 222*b*; (2) the supplemental feed line 228; and (3) the supplemental feed line 230). In one implementation, the differential feed lines 222*a* and 222*b* provide for NFC antenna transmission while the supplemental feed lines 228 and 230 provide for antenna transmissions in other frequency bands, such as Wi-Fi, cellular, Bluetooth®, GPS, etc.

In other implementations, additional points on the bezel 202 are grounded in at points of complete interference apparent when the bezel 202 functions as an NFC antenna. Additional feed lines can then be positioned relative to the additional ground points to allow for selective resonance of the bezel 202 in still additional frequencies (in excess of three total frequencies). Additional filtering components may also be incorporated, as appropriate, to provide filtering at each additional resonance frequency of the bezel 202.

The size of the bezel 202 may vary from one implementation to another based on specific design criteria and a desired frequency band(s) of resonance for the bezel 202. In one implementation that supports NFC signal transmission, the bezel 202 has a length of approximately 45 millimeters and a width of approximately 25 millimeters. The band of the bezel 202 has a substantially planar surface oriented perpendicular to the PCBA 212.

Figure 3:
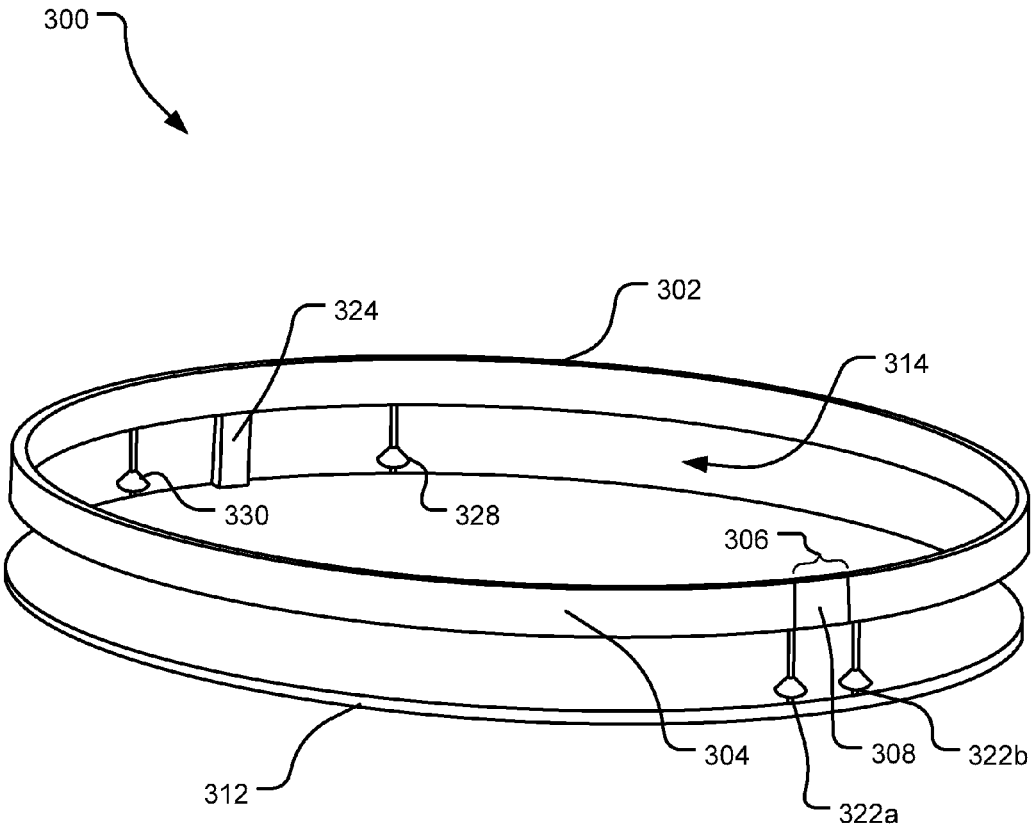
FIG. 3 illustrates a front perspective view of a portion of a wearable electronic accessory including another example bezel configured for resonance in multiple frequency bands.

FIG. 3 illustrates a front perspective view of a portion of another wearable electronic accessory 300 including an example bezel 302 configured for resonance in multiple frequency bands. The bezel 302 includes a circular rim enclosing a region 314 that is sized and shaped to house various electronics (not shown) of the wearable electronic accessory 300. In one implementation where the wearable electronic accessory is a watch, the bezel 302 forms an external surface of the watch, such as a perimeter surface encompassing a watch dial. The position of the bezel 302 may be above, below, or in-line with the watch dial to achieve a desired inductance, which may vary based on specific design details.

The bezel 302 is positioned above and axially aligned with a printed circuit board assembly (PCBA) 312 that provides electrical connections to the various electronics of the wearable electronic assembly that are housed within the enclosed region 314. Although not shown in FIG. 3, a sheet with a high permeability and low magnetic loss (e.g., a ferrite sheet) may be included between the device electronics and the bezel 302 to prevent the device electronics from magnetically coupling with the bezel 302.

The bezel 302 includes a metallic portion 304 and a dielectric insert portion 308. The dielectric insert portion 308 is positioned to fill a slot 306 in the metallic portion 304. Differential feed lines 322*a*, 322*b* straddle the dielectric insert portion 308, providing two alternating current (AC) sources 180 degrees out of phase with one another on opposite sides of the dielectric insert portion 308, as shown. In one implementation, the AC current is of a frequency corresponding to an NFC frequency band.

A metal support 324 electrically grounds the bezel 302 to the PCBA 312 at a point that coincides with a point of complete interference of signals from the differential feed lines 322*a*, 322*b*. In one implementation, the metal support 324 is located at a midpoint (e.g., an exact center along a length) of the metallic portion 304.

Grounding of the metal support 324 (or other point of complete interference) is advantageous because it allows different portions of the bezel 302 to selectively resonate in other frequency bands. For example, supplemental feed lines 328, 330 can be positioned on opposite sides of a grounded point (e.g., the metal support 324) to provide multi-band resonance of the bezel 302. In various implementations, exact positions of the supplemental feed lines 328, 330 may vary based on input signal and desired resonance characteristics.

The supplemental feed line 328 delivers current at a frequency Fl, corresponding to a resonant frequency of the metallic portion 304 along a path from the supplemental feed line 328 to the differential feed lines 322*a*/322*b*. Similarly, the supplemental feed line 330 delivers current at a frequency F2, corresponding to a resonant frequency of the metallic portion 304 along a path from the second supplemental feed line 330 to the differential feed lines 322*a*/322*b*.

The metal support 324 acts as a short for the bands of antenna operation at the frequencies F1 and F2.

The above-described features permit the bezel 302 to resonate in at least three select frequency bands (corresponding to frequencies supplied by (1) the differential feed lines 322*a* and 322*b;* (2) the supplemental feed line 328; and (3) the second supplemental feed line 330). In one implementation, the differential feed lines 322*a* and 322*b* provide for NFC antenna transmission while the supplemental feed lines 328 and 330 provide for antenna transmissions in other frequency bands, such as Wi-Fi, cellular, Bluetooth®, GPS, etc.

Figure 4:
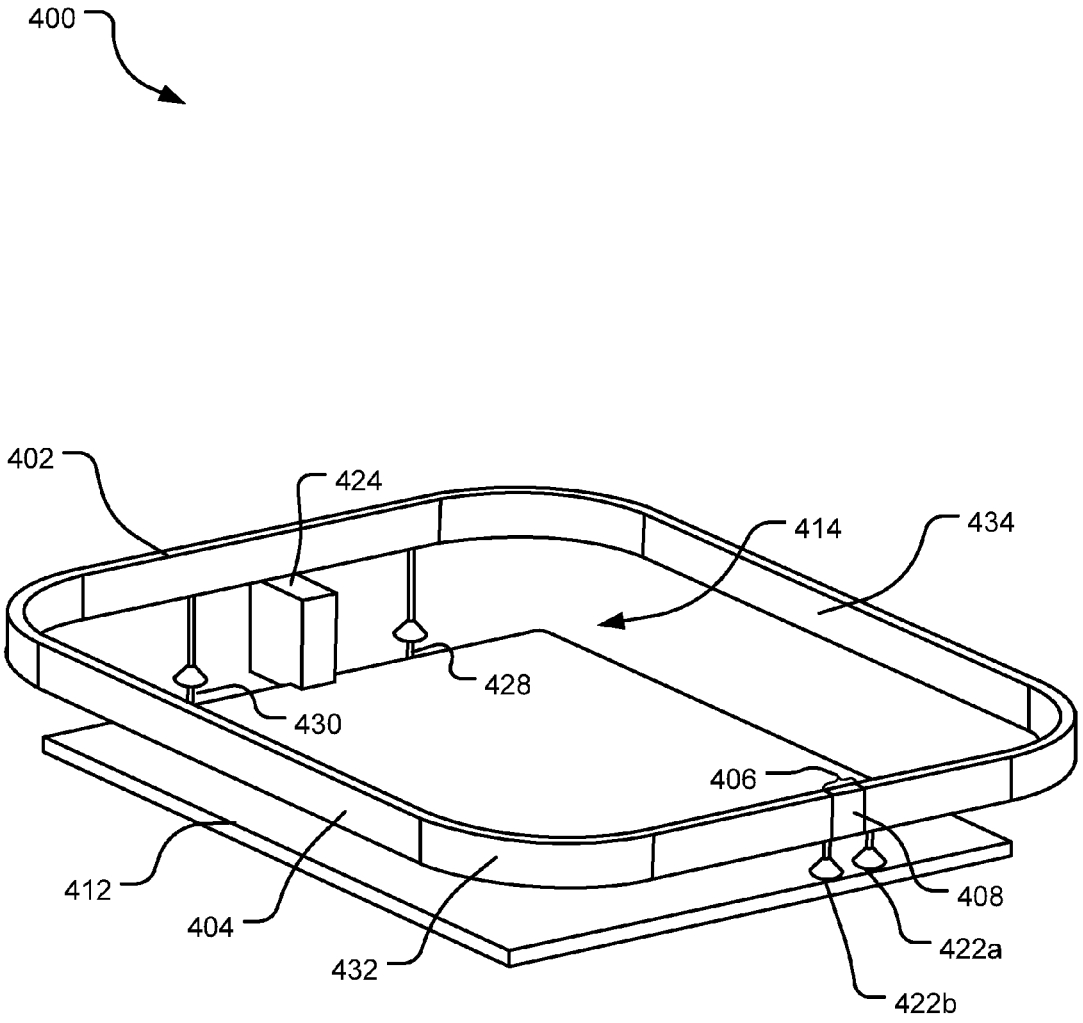
FIG. 4 illustrates a front perspective view of a portion of yet another wearable electronic accessory including another example bezel configured for resonance in multiple frequency bands.

FIG. 4 illustrates a front perspective view of a portion of another wearable electronic accessory 400 including yet another example bezel 402 configured for resonance in multiple frequency bands. The bezel 402 encloses a region 414 that is sized and shaped to house various electronics (not shown) of the wearable electronic accessory 400. The bezel 402 is substantially rectangular with rounded corners. In one implementation where the wearable electronic accessory is a watch, the bezel 402 forms an external surface of the watch, such as a perimeter surface encompassing the watch dial. The position of the bezel 402 may be above, below, or in-line with the watch dial to achieve a desired inductance, which may vary based on specific design details.

The bezel 402 is positioned above and axially aligned with a printed circuit board assembly (PCBA) 412 that provides electrical connections to the various electronics of the wearable electronic assembly 400 that are housed within the enclosed region 414. Although not shown in FIG. 4, a sheet with a high permeability and low magnetic loss (e.g., a ferrite sheet) may be included between the device electronics and the bezel 402 to prevent the device electronics from magnetically coupling with the bezel 402.

The bezel 402 includes a metallic portion 404 and a dielectric insert portion 408. The metallic portion 404 includes several different metallic pieces in direct contact with one another, such as corner pieces (e.g., a corner piece 432) and planar pieces (e.g., a planar piece 434). The dielectric insert portion 408 is positioned to fill a slot 406 in the metallic portion 404. Differential feed lines 422*a,* 422*b* straddle the dielectric insert portion 408, providing two alternating current (AC) sources 180 degrees out of phase with one another on opposite sides of the dielectric insert portion 408, as shown. In one implementation, the AC current is of a frequency corresponding to an NFC frequency band.

A metal support 424 electrically grounds the bezel 402 to the PCBA 412. In one implementation, the metal support 424 is located at a midpoint (e.g., an exact center along a length) of the metallic portion 404. In other implementations, the metal support 424 is located at other locations of complete interference of the signals from the differential feed lines 422*a,* 422*b*. Supplemental feed lines 428, 430 are positioned on opposite sides of the ground point (e.g., the metal support 424) to provide multi-band resonance of the bezel 402. In various implementations, exact positions of the supplemental feed lines 428, 430 vary based on input signal and desired resonance characteristics.

Figure 5:
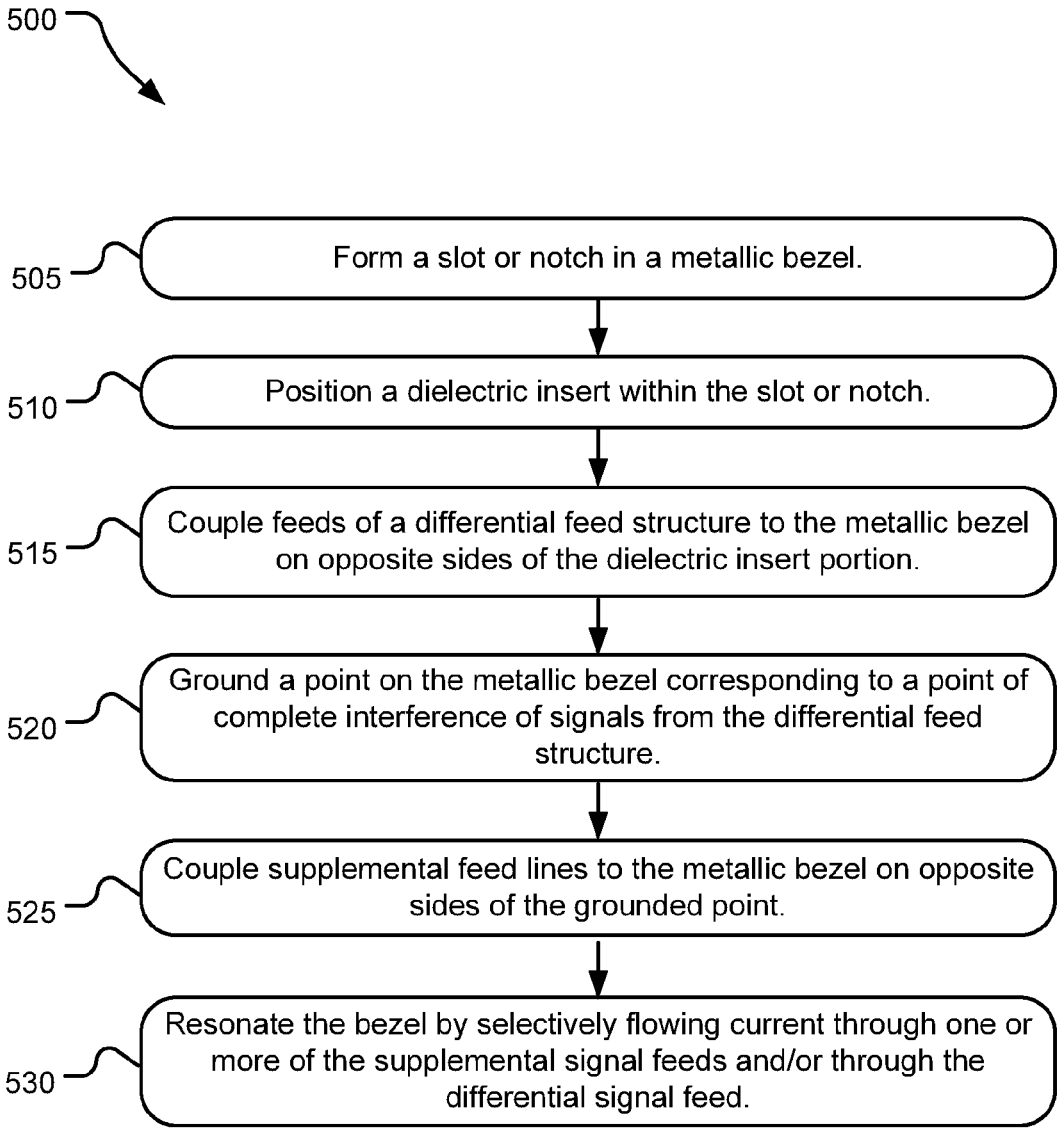
FIG. 5 illustrates example operations for using a bezel as a multi-band antenna.

FIG. 5 illustrates example operations 500 for using a bezel as a multi-band antenna. A formation operation 505 forms a slot or notch in a metallic bezel, and a positioning operation 510 positions a dielectric insert within the slot or notch. A coupling operation 515 couples each feed of a differential feed structure to an opposite end of a metallic bezel (e.g., on opposite sides of the dielectric insert portion). A grounding operation 520 grounds a point of the metallic bezel corresponding to a point of complete interference of signals from the differential feed structure. In one implementation, the grounding operation 520 grounds a midpoint of the metallic bezel. A coupling operation 525 couples supplemental feed lines to the metallic bezel on opposite sides of the grounded midpoint. In one implementation, each of the supplemental feed lines is separated from the grounded midpoint by a distance corresponding to a select signal frequency to be supplied by the feed line. A resonating operation 530 resonates the bezel at one or more of multiple select frequencies by selectively flowing current through one or more of the supplemental signal feeds and/or the differential signal feed. In some implementations, the resonating operation 530 resonates the bezel in multiple frequency bands simultaneously.

An example wearable electronic device includes an antenna that encompasses device electronics and includes a metallic portion and a dielectric insert portion. The metallic portion of the antenna is coupled to a differential feed structure that spans the dielectric insert portion and is electrically grounded at a point of zero potential when current flows from the differential feed structure.

Another example wearable electronic device of any preceding electronic device is disclosed wherein the metallic portion and the dielectric insert portion form a bezel.

Another example wearable electronic device of any preceding electronic device is disclosed wherein the metallic portion of the antenna is coupled to additional signal feeds on opposite sides of the electrically grounded point of the bezel.

Another example wearable electronic device of any preceding electronic device is disclosed wherein the differential feed structure supplies current of a frequency in a near field communication (NFC) band.

Another example wearable electronic device of any preceding electronic device is disclosed wherein the antenna forms the exterior of the wearable electronic device.

Another example wearable electronic device of any preceding electronic device is disclosed wherein the antenna encompasses a device display and also encompasses device electronics housed beneath the device display.

Another example wearable electronic device of any preceding electronic device is disclosed wherein the antenna has a thickness greater than approximately 20 microns.

Another example wearable electronic device of any preceding electronic device is disclosed wherein the wearable electronic device includes a display; and a ferrite sheet behind the display that prevents coupling of the metallic portion with other metallic features of the wearable electronic device.

An example antenna assembly includes a metallic portion with a slot and a dielectric insert portion positioned in the slot, wherein the metallic portion and the dielectric portion form a structural perimeter encompassing device electronics. The antenna assembly further includes a differential feed structure that spans the dielectric insert portion to feed opposite ends of the metallic portion and resonate the antenna at a first frequency. Further still, the antenna assembly includes an electrical ground at a midpoint along a length of the metallic portion, and at least one additional feed structure coupled to the metallic portion to provide selective resonance of the antenna assembly at a second frequency.

Another example antenna assembly of any preceding antenna assembly is disclosed wherein the structural perimeter forms the exterior of a wearable device.

Another example antenna assembly of any preceding antenna assembly is disclosed wherein the differential feed structure supplies current of a frequency in a near field communication (NFC) band.

Another example antenna assembly of any preceding antenna assembly is disclosed wherein the antenna encompasses a device display and also device electronics housed beneath the device display.

Another example antenna assembly of any preceding antenna assembly is disclosed wherein the electrical ground at a point separated from a center of the dielectric insert portion by 180 degrees along a circumference of the antenna.

Another example antenna assembly of any preceding antenna assembly is disclosed wherein the antenna assembly includes a display and a ferrite sheet behind the display that prevents coupling of the antenna with the device electronics.

Another example antenna assembly of any preceding antenna assembly is disclosed wherein the structural perimeter has a thickness greater than approximately 20 microns.

An example method for transmitting a carrier wave includes resonating a metallic portion of an antenna at one of multiple selectable frequencies. The metallic portion is electrically grounded and further includes a slot and a dielectric insert portion positioned within the slot, wherein the dielectric insert portion isolates individual feeds of a differential feed structure coupled to the metallic portion.

Another example method of any of the preceding methods is disclosed wherein the metallic portion and the dielectric insert portion form a bezel.

Another example method of any of the preceding methods is disclosed wherein the metallic portion of the antenna is coupled to additional signal feeds on opposite sides of the electrically grounded point.

Another example method of any of the preceding methods is disclosed wherein the antenna encompasses a device display and device electronics housed beneath the device display.

Another example method of any of the preceding methods is disclosed wherein the antenna is incorporated into a wearable electronic accessory and separated from other electronics of the wearable electronic accessory by a ferrite sheet.

An example antenna assembly includes an antenna and means for resonating a metallic portion of the antenna at one of multiple selectable frequencies. The metallic portion is electrically grounded and further includes a slot and a dielectric insert portion positioned within the slot. The dielectric insert portion isolates individual feeds of a differential feed structure coupled to the metallic portion.

Another example antenna assembly of any preceding antenna assembly is disclosed wherein the metallic portion and the dielectric insert portion form a bezel.

Another example antenna assembly of any preceding antenna assembly is disclosed wherein the metallic portion of the antenna is coupled to additional signal feeds on opposite sides of the electrically grounded point.

Another example antenna assembly of any preceding antenna assembly is disclosed wherein the antenna encompasses a device display and device electronics housed beneath the device display.

Another example antenna assembly of any preceding antenna assembly is disclosed wherein the antenna is incorporated into a wearable electronic accessory and separated from other electronics of the wearable electronic accessory by a ferrite sheet.

The above specification, examples, and data provide a complete description of the structure and use of exemplary implementations. Since many implementations can be made without departing from the spirit and scope of the claimed invention, the claims hereinafter appended define the invention. Furthermore, structural features of the different examples may be combined in yet another implementation without departing from the recited claims.

What is claimed is:

1. A wearable electronic device comprising:

an antenna assembly including:

a structural perimeter encompassing device electronics and formed by a metallic portion and a dielectric insert portion, the dielectric insert portion filling a slot in the metallic portion;

a differential feed structure spanning the dielectric insert portion to feed opposite ends of the metallic portion and resonate the antenna at a first frequency;

an electrical ground at a midpoint along a length of the metallic portion extending from a first feed of the differential feed structure to a second feed of the differential feed structure; and at least one additional feed structure coupled to the metallic portion to provide selective resonance of the antenna assembly at a second frequency.

2. The wearable electronic device of claim 1, wherein the metallic portion and the dielectric insert portion form a bezel.

3. The wearable electronic device of claim 2, wherein the metallic portion of the antenna is coupled to additional signal feeds on opposite sides of the electrically grounded point of the bezel.

4. The wearable electronic device of claim 1, wherein the differential feed structure supplies current of a frequency in a near field communication (NFC) band.

5. The wearable electronic device of claim 1, wherein the antenna assembly forms the exterior of the wearable electronic device.

6. The wearable electronic device of claim 1, wherein the antenna assembly encompasses a device display and also encompasses device electronics housed beneath the device display.

7. The wearable electronic device of claim 1, wherein the antenna assembly has a thickness greater than approximately 20 microns.

8. The wearable electronic device of claim 1, further comprising:

a display; and a ferrite sheet behind the display that prevents coupling of the metallic portion with other metallic features of the wearable electronic device.

9. An antenna assembly comprising:

a structural perimeter encompassing device electronics and formed by a metallic portion and a dielectric insert portion, the dielectric insert portion filling a slot in the metallic portion;

a differential feed structure spanning the dielectric insert portion to feed opposite ends of the metallic portion and resonate the antenna at a first frequency;

an electrical ground at a midpoint along a length of the metallic portion extending from a first feed of the differential feed structure to a second feed of the differential feed structure; and at least one additional feed structure coupled to the metallic portion to provide selective resonance of the antenna assembly at a second frequency.

10. The antenna assembly of claim 9, wherein the structural perimeter forms the exterior of a wearable device.

11. The antenna assembly of claim 9, wherein the differential feed structure supplies current of a frequency in a near field communication (NFC) band.

12. The antenna assembly of claim 9, wherein the antenna encompasses a device display and also device electronics housed beneath the device display.

13. The antenna assembly of claim 9, wherein the electrical ground is at a point separated from a center of the dielectric insert portion by 180 degrees along a circumference of the antenna.

14. The antenna assembly of claim 9 further comprising:

a display; and a ferrite sheet behind the display that prevents coupling of the antenna assembly with the device electronics.

15. The antenna assembly of claim 9, wherein the structural perimeter has a thickness greater than approximately 20 microns.

16. A method comprising:

resonating a metallic portion of an antenna at one of multiple selectable frequencies, the metallic portion electrically grounded at a midpoint along a length extending between individual feeds of a differential feed structure and further including a slot and a dielectric insert portion positioned within the slot, the dielectric insert portion isolating the individual feeds of the differential feed structure coupled to the metallic portion.

17. The method of claim 16, wherein the metallic portion and the dielectric insert portion form a bezel.

18. The method of claim 16, wherein the metallic portion of the antenna is coupled to additional signal feeds on opposite sides of the electrically grounded point.

19. The method of claim 16, wherein the antenna encompasses a device display and device electronics housed beneath the device display.

20. The method of claim 16, wherein the antenna is incorporated into a wearable electronic accessory and separated from other electronics of the wearable electronic accessory by a ferrite sheet.

* * * * *